US012180821B1

(12) United States Patent
Zhang et al.

(10) Patent No.: US 12,180,821 B1
(45) Date of Patent: Dec. 31, 2024

(54) METHOD AND SYSTEM FOR PREDICTING MAXIMUM BUILD RATE OF PUSH-THE-BIT ROTARY STEERING TOOL

(71) Applicant: Chengdu University of Information Technology, Chengdu (CN)

(72) Inventors: Jiantao Zhang, Chengdu (CN); Hanbing Yan, Chengdu (CN); Dongxing Qin, Chengdu (CN)

(73) Assignee: Chengdu University of Information Technology, Chengdu (CN)

( * ) Notice: Subject to any disclaimer, the term of this patent is extended or adjusted under 35 U.S.C. 154(b) by 0 days.

(21) Appl. No.: 18/664,335

(22) Filed: May 15, 2024

(30) Foreign Application Priority Data

Sep. 8, 2023 (CN) ..... 202311154640.3

(51) Int. Cl.
*E21B 44/00* (2006.01)
*E21B 7/06* (2006.01)

(52) U.S. Cl.
CPC ..... *E21B 44/00* (2013.01); *E21B 7/06* (2013.01); *E21B 2200/20* (2020.05)

(58) Field of Classification Search
CPC ..... E21B 44/00; E21B 7/06; E21B 2200/20
See application file for complete search history.

(56) References Cited

U.S. PATENT DOCUMENTS

2009/0000823 A1* 1/2009 Pirovolou ..... E21B 7/04 175/61
2014/0209389 A1* 7/2014 Sugiura ..... E21B 7/067 175/73
2017/0211356 A1* 7/2017 Samuel ..... G05B 17/02
2023/0203935 A1* 6/2023 Dahal ..... E21B 44/06 175/24

* cited by examiner

*Primary Examiner* — Kibrom K Gebresilassie
(74) *Attorney, Agent, or Firm* — Bayramoglu Law Offices LLC

(57) ABSTRACT

A method and system for predicting a maximum build rate of a push-the-bit rotary steering tool is provided. In the method, a mechanical mathematical model of a push-the-bit rotary steering device is combined with measured well inclination data of the rotary steering device during actual drilling, a theoretical maximum build rate of a steering tool is calculated by the mechanical mathematical model, and a correction factor is combined with the mechanical mathematical model to predict a maximum build rate of the steering tool during a drilling operation in a same layer of a same block. The method effectively solves the problem of predicting the maximum build rate of the push-the-bit rotary steering device with different parameter changes based on measured data. Therefore, the method and system provide a reliable means for operators to analyze the performance of the push-the-bit rotary steering device, thereby providing technical support for efficient drilling operations.

14 Claims, 2 Drawing Sheets

METHOD AND SYSTEM FOR PREDICTING MAXIMUM BUILD RATE OF PUSH-THE-BIT ROTARY STEERING TOOL

CROSS REFERENCE TO THE RELATED APPLICATIONS

This application is based upon and claims priority to Chinese Patent Application No. 202311154640.3, filed on Sep. 8, 2023, the entire contents of which are incorporated herein by reference.

TECHNICAL FIELD

The present disclosure relates to the technical field of drilling and mining, and in particular to a method and system for predicting a maximum build rate of a push-the-bit rotary steering tool.

BACKGROUND

Oil and gas are indispensable sources of energy for economic development, but their yield cannot meet the needs of national economic development, resulting in a high degree of dependence on foreign oil and gas resources. Therefore, achieving efficient development of oil and gas resources has always been an important task for major oil companies.

Oil and gas reservoirs are buried at a depth of thousands or even tens of thousands of meters, and are often not located directly below the wellhead. Thus, directional drilling is needed to extend the wellbore trajectory forward to the oil and gas reservoir according to the design shape. The operational capability of directional drilling tools is directly related to efficient development of oil and gas resources. Compared to traditional directional drilling tools (such as screw), rotary steering tools can adjust and control the extension trend of the wellbore trajectory during the rotation of the drill string, thereby achieving a longer footage and a smoother trajectory per unit of drilling time. Therefore, rotary steering tools are a type of efficient directional drilling tool.

In recent years, Chinese major oil companies have successively achieved the localization of rotary steering tools through technological breakthroughs. The operational capability of rotary steering tools is generally evaluated by maximum build rate. For two-dimensional wellbore trajectories, the maximum build rate refers to the maximum rate of inclination change that can be achieved when the rotary steering tool adjusts the extension trend of the wellbore trajectory. For three-dimensional wellbore trajectories, the maximum build rate refers to the maximum rate of overall angle change that can be achieved.

Directional well engineers select appropriate rotary steering tools based on the maximum rate of overall angle change of the designed wellbore trajectory or design the wellbore trajectory based on the maximum build rate of the rotary steering tool. Therefore, estimating the maximum build rate of the rotary steering tool is an important task before using the rotary steering tool for construction. The push-the-bit rotary steering tool is the main type of domestic rotary steering tool. However, there is currently a lack of a method for predicting the maximum build rate of the push-the-bit rotary steering tool by combining a mechanical mathematical model with measured well inclination data.

To solve the above technical problems, it is highly desirable to develop a method and system for predicting a maximum build rate of a push-the-bit rotary steering tool.

SUMMARY

To solve the above technical problems, the present disclosure provides a method for predicting a maximum build rate of a push-the-bit rotary steering tool, including the following steps:

- step 1: selecting a push-the-bit rotary steering device that has been used in an actual directional well operation;
- step 2: calculating, by a mechanical mathematical model, a theoretical maximum build rate of the push-the-bit rotary steering device;
- step 3: calculating a measured maximum build rate in a working well depth interval based on measured well inclination data and a record of a steering force used by the rotary steering device in the working well depth interval;
- step 4: calculating a correction factor based on the theoretical maximum build rate and the measured maximum build rate; and
- step 5: changing a parameter in the mechanical mathematical model based on the correction factor to predict a maximum build rate of the push-the-bit rotary steering device with a different configuration.

In a further solution, the mechanical mathematical model is established by: setting a current wellbore curvature of the rotary steering device as $k_c$, mechanically simplifying the rotary steering device by assuming the rotary steering device as being formed by two beam columns, and acquiring a beam column model of the rotary steering device, where the push-the-bit rotary steering device is simplified to include a drill bit, a stabilizer, and a steering device.

In a further solution, in the calculation by the mechanical mathematical model, parameters are recorded, including an outer diameter $D_{bit}$ of the drill bit, an outer diameter $D_{sta}$ of the stabilizer, a weight on bit WOB, a pushing force $F_p$ generated by a pushing pad, a distance $L_{AC}$ from the drill bit to the pushing pad, a distance $L_{CB}$ from the pushing pad to the stabilizer, a length $L_{AB}$ of the steering device, an outer diameter $D_{ot}$ of the steering device, an inner diameter $D_{it}$ of the steering device, a bending stiffness EI of the steering device, and a linear weight $q_t$ of the steering device, where $L_{AB}=L_{AC}+L_{CB}$.

In a further solution, in the beam column model, a displacement $y_{AC}$ of the rotary steering device under a stress between the drill bit and the pushing pad and a displacement $y_{CB}$ between the pushing pad and the stabilizer are expressed as follows:

$$y_{AC} = c_2\cos\left(x\sqrt{\frac{WOB\cos(L_{AB}k_c)}{EI}}\right) + c_1\sin\left(x\sqrt{\frac{WOB\cos(L_{AB}k_c)}{EI}}\right) + \frac{x^2 q_t \sec(L_{AB}k_c)}{2WOB} + c_3x + c_4; \quad (1)$$

$$y_{CB} = c_6\cos\left(x\sqrt{\frac{WOB\cos(L_{AB}k_c)}{EI}}\right) + c_5\sin\left(x\sqrt{\frac{WOB\cos(L_{AB}k_c)}{EI}}\right) + \frac{x^2 q_t \sec(L_{AB}k_c)}{2WOB} + c_7x + c_8; \quad (2)$$

where, $c_1$, $c_2$, $c_3$, $c_4$, $c_5$, $c_6$, $c_7$, and $c_8$ denote 8 coefficients to be solved, and are calculated by the following boundary conditions:

$$y_{AC}|_{x=-L_{AB}} = \frac{1}{2} \times k_c \times L_{AB}^2 + \frac{D_{bit}}{2} \tag{3}$$

$$y_{AC}|_{x=-L_{CB}} = y_{CB}|_{x=-L_{CB}} \tag{4}$$

$$y_{CB}|_{x=0} = \frac{D_{sta}}{2} + (D_{bit} - D_{sta}) \tag{5}$$

$$\frac{dy_{AC}}{dx}|_{x=-L_{AB}} = 0 \tag{6}$$

$$\left.\frac{dy_{AC}}{dx}\right|_{x=-L_{CB}} = \left.\frac{dy_{CB}}{dx}\right|_{x=-L_{CB}} \tag{7}$$

$$\left.\frac{d^2y_{AC}}{dx^2}\right|_{x=-L_{CB}} = \left.\frac{d^2y_{CB}}{dx^2}\right|_{x=-L_{CB}} \tag{8}$$

$$\left.\frac{d^2y_{CB}}{dx^2}\right|_{x=0} = 0 \tag{9}$$

$$-EI\left.\frac{d^3y_{AC}}{dx^3}\right|_{x=-L_{AB}} - F_c\left.\frac{dy_{AC}}{dx}\right|_{x=-L_{CB}} - EI\left.\frac{d^3y_{CB}}{dx^3}\right|_{x=-L_{CB}} - F_c\frac{dy_{CB}}{dx} = F_{pmax} \tag{10}$$

where, $F_c$=WOB×cos ($k_c$×$L_{AB}$).

In a further solution, after the 8 coefficients to be solved are calculated, a lateral force on the drill bit is calculated:

$$F_d = EI\left.\frac{d^3y_{AC}}{dx^3}\right|_{x=-L_{AB}} + F_c\left.\frac{dy_{AC}}{dx}\right|_{x=-L_{AB}} - WOB \times \sin(k_c \times L_{AB}) \tag{11}$$

where, $F_d$ denotes the lateral force on the drill bit.

In a further solution, after the lateral force on the drill bit is calculated, the theoretical maximum build rate of the rotary steering device is calculated:

$$k_{max}=\text{FindRoot}(F_d=0,k_c) \tag{12}$$

where, $k_{max}$ denotes the maximum build rate; the theoretical maximum build rate is acquired by letting the lateral force $F_d$ on the drill bit be 0 and calculating the wellbore curvature $k_c$ in the expression; and FindRoot denotes a root-finding function.

In a further solution, after predicting the theoretical maximum build rate, measured well inclination data of a rotary steering tool with a same parameter during a drilling operation in a certain layer of a certain block is processed, and a measured maximum build rate of the steering tool during drilling in the layer is calculated as follows:

a series of steering commands during the operation in the layer are assumed as including different steering force percentages SFR and steering orientations STF, a starting well depth and an ending well depth of each steering command in an action period are defined as $MD_{st}$ and $MD_{ed}$, respectively, and a measured maximum build rate in a well depth interval under the action of the command is calculated:

$$Dogleg_{max}^{i} = \frac{DoglegFun(Inc_{st}, Azi_{st}, Inc_{ed}, Azi_{ed})}{(MD_{ed} - MD_{st}) \times \frac{SFR}{100}} \tag{13}$$

where, DoglegFun denotes a dogleg calculation function that is a common calculation function in directional well engineering;

a set of measured maximum build rates for different steering commands during the operation in the layer is calculated, and a representative measured maximum build rate from n measured maximum build rates of the set is selected by using different filtering methods, specifically a median taking method or an average taking method:

$$Dogleg_{max}=\text{FilterFun}(Dogleg_{max}^{1},Dogleg_{max}^{2},Dogleg_{max}^{3}, \ldots ,Dogleg_{max}^{n}) \tag{14}$$

where, FilterFun denotes a filtering function, and a corresponding filtering method is used as needed.

In a further solution, the correction factor α is calculated based on the measured maximum build rate and the theoretical maximum build rate:

$$\alpha = \frac{Dogleg_{max}}{k_{max}} \tag{15}$$

where, $k_{max}$ denotes the maximum build rate, and $Dogleg_{max}$ denotes the measured maximum build rate.

In a further solution, after the correction factor α is calculated, different parameters are substituted into the mechanical mathematical model expressed by Eqs. (1) to (12) to predict the maximum build rate $k_{RSS}$ of the rotary steering device in the same layer of the same block:

$$k_{RSS}=\alpha \times k_{max} \tag{16}$$

where, α denotes the correction factor, and $k_{max}$ denotes the maximum build rate.

The present disclosure provides a computer system, including a memory and a processor, where the memory is configured to store a computer program executable on the processor; and the processor is configured to execute the computer program to implement the steps of the method for predicting a maximum build rate of a push-the-bit rotary steering tool according to any one of the above paragraphs.

Compared with the prior art, in the present disclosure, the method and system for predicting a maximum build rate of a push-the-bit rotary steering tool have the following beneficial effects.

In the present disclosure, the mechanical mathematical model of the push-the-bit rotary steering device is combined with the measured well inclination data of the rotary steering device during actual drilling, the theoretical maximum build rate of the steering tool is calculated by the mechanical mathematical model, and the correction factor is combined with the mechanical mathematical model to predict the maximum build rate of the steering tool during the drilling operation in the same layer of the same block. The present disclosure effectively solves the problem of predicting the maximum build rate of the push-the-bit rotary steering device with different parameter changes based on the measured data. Therefore, the method provided by the present disclosure provides a more reliable means for operators to analyze the performance of the push-the-bit rotary steering device, thereby providing technical support for efficient drilling operations. The present disclosure has high practicability and application value.

DETAILED DESCRIPTION OF THE EMBODIMENTS

The present disclosure is further described below with reference to the drawings and implementations.

Figure 1:
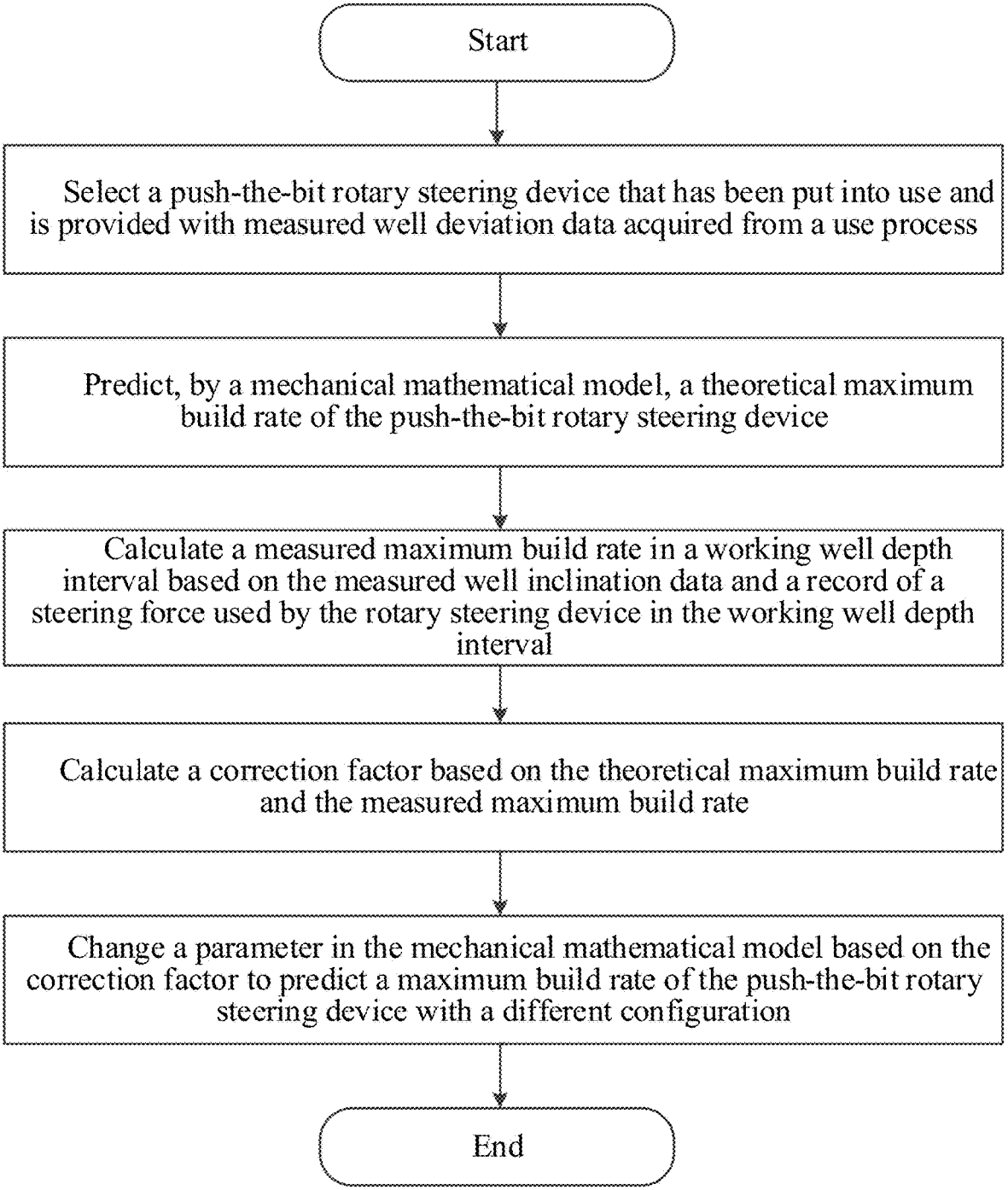
FIG. 1 is a flowchart of a method and system for predicting a maximum build rate of a push-the-bit rotary steering tool according to the present disclosure.

An embodiment of the present disclosure provides a method for predicting a maximum build rate of a push-the-bit rotary steering tool. As shown in FIG. 1, the method includes the following steps.

Step 1. A push-the-bit rotary steering device that has been used in an actual directional well operation is selected.

Step 2. A theoretical maximum build rate of the push-the-bit rotary steering device is calculated by a mechanical mathematical model.

Step 3. A measured maximum build rate in a working well depth interval is calculated based on measured well inclination data and a record of a steering force used by the rotary steering device in the working well depth interval.

Step 4. A correction factor is calculated based on the theoretical maximum build rate and the measured maximum build rate.

Step 5. A parameter in the mechanical mathematical model is changed based on the correction factor to predict a maximum build rate of the push-the-bit rotary steering device with a different configuration.

It should be noted that in this embodiment, the mechanical mathematical model is established by analyzing the structure of the push-the-bit rotary steering tool, and the theoretical maximum build rate is calculated based on the mechanical mathematical model. Then, the measured maximum build rate of the steering tool is calculated based on the measured well inclination data and the steering commands of the rotary steering tool, and the correction factor is calculated based on the measured maximum build rate and the theoretical maximum build rate. Finally, the maximum build rate of the push-the-bit rotary steering tool is predicted based on the correction factor. In this way, a method for predicting the maximum build rate of the push-the-bit rotary steering tool by combining the mechanical mathematical model with the measured well inclination data is formed.

Specifically, in the method of predicting the maximum build rate of the push-the-bit rotary steering tool based on the mechanical mathematical model and the measured well inclination data, firstly, the mechanical mathematical model is established according to the structure of the push-the-bit rotary steering tool, and the theoretical maximum build rate of the steering tool is calculated based on the mechanical mathematical model. Then, the measured well inclination data of the steering tool in a certain well depth interval during the drilling operation in a certain layer underground is combined with the steering commands of the rotary steering tool to acquire a set of measured maximum build rates of the steering tool in that well depth interval. The set is processed to acquire a representative measured maximum build rate of the steering tool. Based on the measured maximum build rate and the theoretical maximum build rate, the correction factor is calculated. Finally, the correction factor is combined with the mechanical mathematical model to predict the maximum build rate of the steering tool during the drilling operation in the same layer of the same block.

The present disclosure combines the mechanical mathematical model of the push-the-bit rotary steering device with the measured well inclination data of the rotary steering device during actual drilling. The present disclosure effectively solves the problem of predicting the maximum build rate of the push-the-bit rotary steering device with different parameter changes based on the measured data. Therefore, the method provided by the present disclosure provides a more reliable means for operators to analyze the performance of the push-the-bit rotary steering device, thereby providing technical support for efficient drilling operations.

In a further solution, the mechanical mathematical model is established by: setting a current wellbore curvature of the rotary steering device as $k_c$, mechanically simplifying the rotary steering device by assuming the rotary steering device as being formed by two beam columns, and acquiring a beam column model of the rotary steering device, where the push-the-bit rotary steering device is simplified to include a drill bit, a stabilizer, and a steering device.

Figure 2:
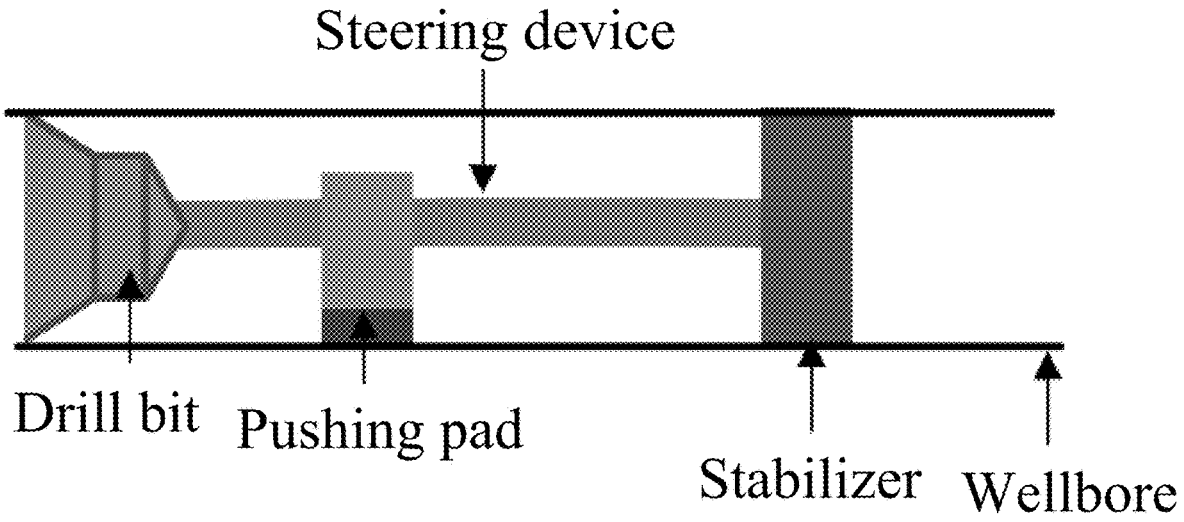
FIG. 2 is a structural diagram of a push-the-bit rotary steering device in a wellbore according to the present disclosure.
Figure 3:
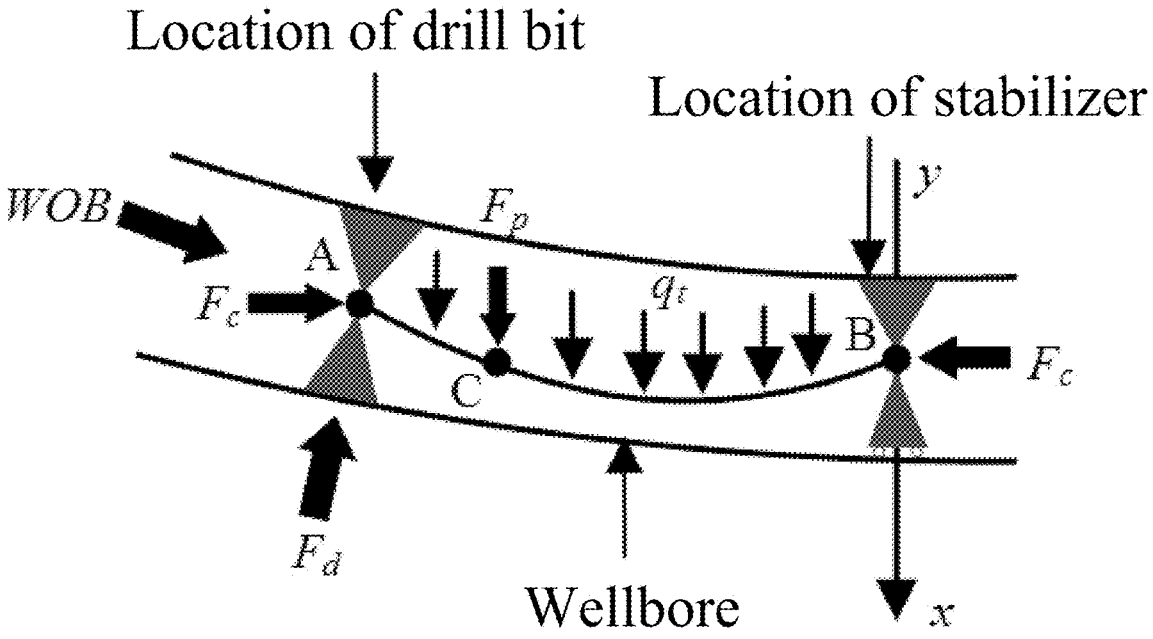
FIG. 3 is a force diagram of a mechanical mathematical model of the push-the-bit rotary steering device in the wellbore according to the present disclosure.

It should be noted that as shown in FIG. 2, the current wellbore curvature of the rotary steering device is assumed as $k_c$, and the rotary steering device is mechanically simplified. Specifically, the rotary steering device is assumed as being formed by two beam columns, and a beam column model of the rotary steering device is acquired. In the present disclosure, according to the major composition of the push-the-bit rotary steering device, the rotary steering device is simplified to include a drill bit, a stabilizer, and a steering device, as shown in FIG. 3. An element of the steering device that applies a pushing force is called a pushing pad. The pushing pad applies the pushing force to a well wall, which generates a counterforce on the drill bit. In this way, a lateral force on the drill bit changes, changing a cutting direction of the drill bit in a formation, such that a trajectory extends according to a preset design.

In a further solution, in the calculation by the mechanical mathematical model, parameters are recorded, including outer diameter $D_{bit}$ of the drill bit, outer diameter $D_{sta}$ of the stabilizer, weight on bit WOB, pushing force $F_p$ generated by a pushing pad, distance $L_{AC}$ from the drill bit to the pushing pad, distance $L_{CB}$ from the pushing pad to the stabilizer, length $L_{AB}$ of the steering device, outer diameter $D_{ot}$ of the steering device, inner diameter $D_{it}$ of the steering device, bending stiffness EI of the steering device, and linear weight $q_t$ of the steering device, where $L_{AB}=L_{AC}+L_{CB}$.

In a further solution, in the beam column model, a displacement $y_{AC}$ of the rotary steering device under a stress between the drill bit and the pushing pad and a displacement $y_{CB}$ between the pushing pad and the stabilizer are expressed as follows:

$$y_{AC} = c_2\cos\left(x\sqrt{\frac{WOB\cos(L_{AB}k_c)}{EI}}\right)+ \tag{1}$$

-continued $$y_{CB} = c_6\cos\left(x\sqrt{\frac{WOB\cos(L_{AB}k_c)}{EI}}\right) + c_1\sin\left(x\sqrt{\frac{WOB\cos(L_{AB}k_c)}{EI}}\right) + \frac{x^2 q_t \sec(L_{AB}k_c)}{2WOB} + c_3x + c_4; \quad (2)$$

$$c_5\sin\left(x\sqrt{\frac{WOB\cos(L_{AB}k_c)}{EI}}\right) + \frac{x^2 q_t \sec(L_{AB}k_c)}{2WOB} + c_7x + c_8;$$

where, $c_1$, $c_2$, $c_3$, $c_4$, $c_5$, $c_6$, $c_7$, and $c_8$ denote 8 coefficients to be solved, and are calculated by the following boundary conditions:

$$y_{AC}|_{x=-L_{AB}} = \frac{1}{2}\times k_c \times L_{AB}^2 + \frac{D_{bit}}{2} \quad (3)$$

$$y_{AC}|_{x=-L_{CB}} = y_{CB}|_{x=-L_{CB}} \quad (4)$$

$$y_{CB}|_{x=0} = \frac{D_{sta}}{2} + (D_{bit} - D_{sta}) \quad (5)$$

$$\frac{dy_{AC}}{dx}|_{x=-L_{AB}} = 0 \quad (6)$$

$$\left.\frac{dy_{AC}}{dx}\right|_{x=-L_{CB}} = \left.\frac{dy_{CB}}{dx}\right|_{x=-L_{CB}} \quad (7)$$

$$\left.\frac{d^2y_{AC}}{dx^2}\right|_{x=-L_{CB}} = \left.\frac{d^2y_{CB}}{dx^2}\right|_{x=-L_{CB}} \quad (8)$$

$$\left.\frac{d^2y_{CB}}{dx^2}\right|_{x=0} = 0 \quad (9)$$

$$-EI\left.\frac{d^3y_{AC}}{dx^3}\right|_{x=-L_{AB}} - F_c\left.\frac{dy_{AC}}{dx}\right|_{x=-L_{CB}} - EI\left.\frac{d^3y_{CB}}{dx^3}\right|_{x=-L_{CB}} - F_c\frac{dy_{CB}}{dx} = F_{pmax} \quad (10)$$

where, $F_c$=WOB×cos ($k_c$×$L_{AB}$).

In a further solution, after the 8 coefficients to be solved are calculated, a lateral force on the drill bit is calculated:

$$F_d = EI\left.\frac{d^3y_{AC}}{dx^3}\right|_{x=-L_{AB}} + F_c\left.\frac{dy_{AC}}{dx}\right|_{x=-L_{AB}} - WOB\times\sin(k_c\times L_{AB}) \quad (11)$$

where, $F_d$ denotes the lateral force on the drill bit.

In a further solution, after the lateral force on the drill bit is calculated, the theoretical maximum build rate of the rotary steering device is calculated:

$$k_{max}=\text{FindRoot}(F_d=0,k_c) \quad (12)$$

where, $k_{max}$ denotes the maximum build rate; the theoretical maximum build rate is acquired by letting the lateral force Fa on the drill bit be 0 and calculating the wellbore curvature $k_c$ in the expression; and FindRoot denotes a root-finding function.

In a further solution, after predicting the theoretical maximum build rate, measured well inclination data of a rotary steering tool with a same parameter during a drilling operation in a certain layer of a certain block is processed, and a measured maximum build rate of the steering tool during drilling in the layer is calculated as follows:

A series of steering commands during the operation in the layer are assumed as including different steering force percentages SFR and steering orientations STF, a starting well depth and an ending well depth of each steering command in an action period are defined as $MD_{st}$ and $MD_{ed}$, respectively, and a measured maximum build rate in a well depth interval under the action of the command is calculated:

$$Dogleg^i_{max} = \frac{DoglegFun(Inc_{st}, Azi_{st}, Inc_{ed}, Azi_{ed})}{(MD_{ed} - MD_{st})\times\frac{SFR}{100}} \quad (13)$$

where, DoglegFun denotes a dogleg calculation function that is a common calculation function in directional well engineering.

A set of measured maximum build rates for different steering commands during the operation in the layer is calculated, and a representative measured maximum build rate from n measured maximum build rates of the set is selected by using different filtering methods, specifically a median taking method or an average taking method:

$$\text{Dogleg}_{max}=\text{FilterFun}(\text{Dogleg}_{max}^1,\text{Dogleg}_{max}^2,\text{Dogleg}_{max}^3,\ldots,\text{Dogleg}_{max}^n) \quad (14)$$

where, FilterFun denotes a filtering function, and a corresponding filtering method is used as needed.

In a further solution, the correction factor α is calculated based on the measured maximum build rate and the theoretical maximum build rate:

$$\alpha = \frac{Dogleg_{max}}{k_{max}} \quad (15)$$

where, $k_{max}$ denotes the maximum build rate, and $Dogleg_{max}$ denotes the measured maximum build rate.

In a further solution, after the correction factor α is calculated, different parameters are substituted into the mechanical mathematical model expressed by Eqs. (1) to (12) to predict the maximum build rate $k_{RSS}$ of the rotary steering device in the same layer of the same block:

$$k_{RSS}=\alpha\times k_{max} \quad (16)$$

where, α denotes the correction factor, and $k_{max}$ denotes the maximum build rate.

The present disclosure provides a computer system, including a memory and a processor, where the memory is configured to store a computer program executable on the processor; and the processor is configured to execute the computer program to implement the steps of the method for predicting a maximum build rate of a push-the-bit rotary steering tool according to any one of the above paragraphs.

The present disclosure is described in more detail below according to a specific embodiment.

A first step is to record the parameters used in the mechanical mathematical model to calculate the theoretical maximum build rate of the push-the-bit rotary steering device, as shown in Table 1. According to the calculation process sown in Eqs. (1) to (12), substituting the parameters in Table 1 yields a theoretical maximum build rate of 12.94°/30 m.

TABLE 1

| Push-the-bit rotary steering device | | | | |
|---|---|---|---|---|
| Outer diameter of drill bit mm | Outer diameter of stabilizer mm | Weight on bit kN | Pushing force generated by pad of steering device kN | Outer diameter of steering device mm |
| 215.9 | 212 | 150 | 30 | 190 |
| Linear weight of steering device N/m | Bending stiffness of steering device $N \cdot m^2$ | Distance between drill bit and pushing pad m | Distance between pushing pad and stabilizer m | Inner diameter of steering device mm |
| 2023.21 | $4.053 \times 10^6$ | 0.67 | 1.3 | 50 |

A second step is to record the measured well inclination data and steering commands of the rotary steering device during the operation in a certain layer of certain block, as shown in Tables 2 and 3. Based on the data in Tables 2 and 3, the measured maximum build rates corresponding to the well depth intervals of four steering commands are calculated as 7.34°/30 m, 9.95°/30 m, 7.76°/30 m, and 8.44°/30 m, respectively. By averaging, a measured maximum build rate of 8.40°/30 m at the working well depth is acquired.

TABLE 2

| Record of well inclination data | | |
|---|---|---|
| Well depth m | Inclination angle ° | Azimuth angle ° |
| 3360.4 | 44.4 | 229.6 |
| 3379.3 | 45.7 | 225.6 |
| 3397.7 | 48.1 | 222.6 |
| 3416.7 | 49.8 | 219.6 |
| 3454.9 | 53.3 | 212.1 |
| 3360.4 | 44.4 | 229.6 |

TABLE 3

| Record of steering commands | | | |
|---|---|---|---|
| Starting well depth m | Ending well depth m | Pushing force percentage % | Pushing force direction ° |
| 3371.00 | 3391.02 | 45 | 290 |
| 3391.02 | 3403.00 | 50 | 280 |
| 3403.00 | 3409.80 | 55 | 275 |
| 3409.80 | 3428.60 | 60 | 275 |

A third step is to calculate a correction factor of 0.65 based on the theoretical maximum build rate and the measured maximum build rate.

A fourth step is to change the data in Table 1 to calculate the theoretical maximum build rate of the rotary steering device based on different configuration parameters. For example, when the maximum pushing force of the pad in Table 1 is changed to 25 KN, the theoretical maximum build rate is 11.27°/30 m. Based on the acquired correction factor, the maximum build rate of the rotary steering device is 7.33°/30 m.

In summary, this embodiment provides a method for predicting a maximum build rate of a push-the-bit rotary steering tool by combining a mechanical mathematical model with measured well inclination data. Through this method, operators can design the wellbore trajectory based on the maximum build rate of the rotary steering tool, select a rotary steering tool that meets the requirements for adjusting the trajectory trend based on the designed wellbore trajectory, or adjust the structure of the rotary steering tool based on the requirements for the tool's maximum build rate during operation. In this way, during the operation of the rotary steering tool, operators can well control and adjust the extension trend of the wellbore trajectory, thereby improving operational efficiency.

The above is merely an embodiment of the present disclosure and does not constitute a limitation on the patent scope of the present disclosure. Any equivalent structure or equivalent process change made by using the specification and the drawings of the present disclosure, or direct or indirect application thereof in other related technical fields, should still fall in the protection scope of the patent of the present disclosure.

What is claimed is:

1. A method for predicting a maximum build rate of a push-the-bit rotary steering tool, comprising the following steps:

step 1: selecting a push-the-bit rotary steering device that has been used in an actual directional well operation;

step 2: calculating, by a mechanical mathematical model, a theoretical maximum build rate of the push-the-bit rotary steering device;

step 3: calculating a measured maximum build rate in a working well depth interval based on measured well inclination data and a record of a steering force used by the push-the-bit rotary steering device in the working well depth interval;

step 4: calculating a correction factor based on the theoretical maximum build rate and the measured maximum build rate; and step 5: changing a parameter in the mechanical mathematical model based on the correction factor to predict a maximum build rate of the push-the-bit rotary steering device with a different configuration;

step 6: adjusting a structure of the rotary steering tool based on the predicted maximum build rate during operation, wherein, the mechanical mathematical model is established by: setting a current wellbore curvature of the push-the-bit rotary steering device as $k_c$, mechanically simplifying the push-the-bit rotary steering device by assuming the push-the-bit rotary steering device as being formed by two beam columns, and acquiring a beam column model of the push-the-bit rotary steering device, wherein the push-the-bit rotary steering device is simplified to comprise a drill bit, a stabilizer, and a steering device, wherein in the calculation by the mechanical mathematical model, parameters are recorded, comprising: an outer diameter $D_{bit}$ of the drill bit, an outer diameter $D_{sta}$ of the stabilizer, a weight on bit WOB, a pushing force $F_p$ generated by a pushing pad, maximum pushing force $F_{pmax}$ generated by a pushing pad a distance $L_{AC}$ from the drill bit to the pushing pad, a distance $L_{CB}$ from the pushing pad to the stabilizer, a length $L_{AB}$ of the steering device, an outer diameter $D_{ot}$ of the steering device, an inner diameter $D_{it}$ of the steering device, a bending stiffness EI of the steering device, and a linear weight $q_t$ of the steering device, wherein $L_{AB}=L_{AC}+L_{CB}$, wherein in the beam column model, a displacement $y_{AC}$ of the push-the-bit rotary steering device under a stress between the drill bit and the pushing pad and a displacement $y_{CB}$ between the pushing pad and the stabilizer are expressed as follows:

$$y_{AC} = c_2\cos\left(x\sqrt{\frac{WOB\cos(L_{AB}k_c)}{EI}}\right) + c_1\sin\left(x\sqrt{\frac{WOB\cos(L_{AB}k_c)}{EI}}\right) + \frac{x^2 q_t\sec(L_{AB}k_c)}{2WOB} + c_3x + c_4; \quad (1)$$

$$y_{CB} = c_6\cos\left(x\sqrt{\frac{WOB\cos(L_{AB}k_c)}{EI}}\right) + c_5\sin\left(x\sqrt{\frac{WOB\cos(L_{AB}k_c)}{EI}}\right) + \frac{x^2 q_t\sec(L_{AB}k_c)}{2WOB} + c_7x + c_8; \quad (2)$$

wherein, $c_1$, $c_2$, $c_3$, $c_4$, $c_5$, $c_6$, $c_7$, and $c_8$ denote 8 coefficients to be solved, and are calculated by the following boundary conditions:

$$y_{AC}|_{x=-L_{AB}} = \frac{1}{2}\times k_c\times L_{AB}^2 + \frac{D_{bit}}{2} \quad (3)$$

$$y_{AC}|_{x=-L_{CB}} = y_{CB}|_{x=-L_{CB}} \quad (4)$$

$$y_{CB}|_{x=0} = \frac{D_{sta}}{2} + (D_{bit} - D_{sta}) \quad (5)$$

$$\left.\frac{dy_{AC}}{dx}\right|_{x=-L_{AB}} = 0 \quad (6)$$

$$\left.\frac{dy_{AC}}{dx}\right|_{x=-L_{CB}} = \left.\frac{dy_{CB}}{dx}\right|_{x=-L_{CB}} \quad (7)$$

$$\left.\frac{d^2y_{AC}}{dx^2}\right|_{x=-L_{CB}} = \left.\frac{d^2y_{CB}}{dx^2}\right|_{x=-L_{CB}} \quad (8)$$

$$\left.\frac{d^2y_{CB}}{dx^2}\right|_{x=0} = 0 \quad (9)$$

$$-EI\left.\frac{d^3y_{AC}}{dx^3}\right|_{x=-L_{CB}} - F_c\left.\frac{dy_{AC}}{dx}\right|_{x=-L_{CB}} - EI\left.\frac{d^3y_{CB}}{dx^3}\right|_{x=-L_{CB}} - F_c\left.\frac{dy_{CB}}{dx}\right|_{x=-L_{CB}} = F_{pmax} \quad (10)$$

wherein, $F_c = WOB\times\cos(k_c\times L_{AB})$.

2. The method for predicting the maximum build rate of the push-the-bit rotary steering tool according to claim 1, wherein after the 8 coefficients to be solved are calculated, a lateral force on the drill bit is calculated:

$$F_d = EI\left.\frac{d^3y_{AC}}{dx^3}\right|_{x=-L_{AB}} + F_c\left.\frac{dy_{AC}}{dx}\right|_{x=-L_{AB}} - WOB\times\sin(k_c\times L_{AB}) \quad (11)$$

wherein, $F_d$ denotes the lateral force on the drill bit.

3. The method for predicting the maximum build rate of the push-the-bit rotary steering tool according to claim 1, wherein after the lateral force on the drill bit is calculated, the theoretical maximum build rate of the push-the-bit rotary steering device is calculated:

$$k_{max}=\text{FindRoot}(F_d=0,k_c) \quad (12)$$

wherein, $k_{max}$ denotes the maximum build rate; the theoretical maximum build rate is acquired by letting the lateral force $F_d$ on the drill bit be 0 and calculating the wellbore curvature $k_c$ in the expression; and FindRoot denotes a root-finding function.

4. The method for predicting the maximum build rate of the push-the-bit rotary steering tool according to claim 1, wherein after predicting the theoretical maximum build rate, measured well inclination data of a rotary steering tool with a same parameter during a drilling operation in a certain layer of a certain block is processed, and a measured maximum build rate of the rotary steering tool during drilling in the layer is calculated as follows:

a series of steering commands during the operation in the layer are assumed as comprising different steering force percentages and steering orientations, a starting well depth and an ending well depth of each steering command in an action period are defined, and a measured maximum build rate in a well depth interval under the action of the command is calculated:

wherein, $Inc_{st}$ denotes an inclination angle at a starting point of a steering command interval, and $Azi_{st}$ denotes an azimuth angle at the starting point of the steering command interval;

$$Dogleg_{mac}^{i} = \frac{DoglegFun(Inc_{si}, Azi_{st}, Inc_{ed}, Azi_{ed})}{(MD_{ed} - MD_{st})\times\frac{SFR}{100}} \quad (13)$$

$MD_{st}$ denotes a well depth at the starting point of the steering command interval; $Inc_{ed}$ denotes an inclination angle at an ending point of the steering command interval; $Azi_{ed}$ denotes an azimuth angle at the ending point of the steering command interval; $MD_{ed}$ denotes a well depth at the ending point of the steering command interval; and DoglegFun denotes a dogleg calculation function for a trajectory formed in the steering command interval; and a set of measured maximum build rates for different steering commands during the operation in the layer is calculated, and a representative measured maximum build rate from n measured maximum build rates of the set is selected by using different filtering methods comprising a median taking method or an average taking method:

$$Dogleg_{max}=\text{FilterFun}(Dogleg_{max}^{1},Dogleg_{max}^{2},Dogleg_{max}^{3},\ldots,Dogleg_{max}^{n}) \quad (14)$$

wherein, FilterFun denotes a filtering function, SFR denotes steering force percentage, and a corresponding filtering method is used as needed.

5. The method for predicting the maximum build rate of the push-the-bit rotary steering tool according to claim 1, wherein the correction factor α is calculated based on the measured maximum build rate and the theoretical maximum build rate:

$$\alpha = \frac{Dogleg_{max}}{k_{max}} \tag{15}$$

wherein, $k_{max}$ denotes the maximum build rate, and $Dogleg_{max}$ denotes the measured maximum build rate.

6. The method for predicting the maximum build rate of the push-the-bit rotary steering tool according to claim 1, wherein after the correction factor α is calculated, different parameters are substituted into the mechanical mathematical model expressed by Eqs. (1) to (12) to predict the maximum build rate $k_{RSS}$ of the push-the-bit rotary steering device in the same layer of the same block:

$$k_{RSS}=\alpha\times k_{max} \tag{16}$$

wherein, α denotes the correction factor, and $k_{max}$ denotes the maximum build rate.

7. A computer system, comprising a processor and a memory, wherein the memory is configured to store a computer program executable on the processor; and the processor is configured to execute the computer program to implement steps of the method for predicting the maximum build rate of the push-the-bit rotary steering tool according to claim 1.

8. The computer system according to claim 7, wherein in the calculation by the mechanical mathematical model, parameters are recorded, comprising: an outer diameter $D_{bit}$ of the drill bit, an outer diameter $D_{sta}$ of the stabilizer, a weight on bit WOB, a pushing force $F_p$ generated by a pushing pad, a distance $L_{AC}$ from the drill bit to the pushing pad, a distance $L_{CB}$ from the pushing pad to the stabilizer, a length $L_{AB}$ of the steering device, an outer diameter $D_{ot}$ of the steering device, an inner diameter $D_{it}$ of the steering device, a bending stiffness EI of the steering device, and a linear weight $q_t$ of the steering device, wherein $L_{AB}=L_{AC}+L_{CB}$.

9. The computer system according to claim 8, wherein in the beam column model, a displacement $y_{AC}$ of the push-the-bit rotary steering device under a stress between the drill bit and the pushing pad and a displacement $y_{CB}$ between the pushing pad and the stabilizer are expressed as follows:

$$y_{AC} = c_2\cos\left(x\sqrt{\frac{WOB\cos(L_{AB}k_c)}{EI}}\right) + c_1\sin\left(x\sqrt{\frac{WOB\cos(L_{AB}k_c)}{EI}}\right) + \frac{x^2 q_t\sec(L_{AB}k_c)}{2WOB} + c_3x + c_4; \tag{1}$$

$$y_{CB} = c_6\cos\left(x\sqrt{\frac{WOB\cos(L_{AB}k_c)}{EI}}\right) + c_5\sin\left(x\sqrt{\frac{WOB\cos(L_{AB}k_c)}{EI}}\right) + \frac{x^2 q_t\sec(L_{AB}k_c)}{2WOB} + c_7x + c_8; \tag{2}$$

wherein, $c_1$, $c_2$, $c_3$, $c_4$, $c_5$, $c_6$, $c_7$, and $c_8$ denote 8 coefficients to be solved, and are calculated by the following boundary conditions:

$$y_{AC}|_{x=-L_{AB}} = \frac{1}{2}\times k_c\times L_{AB}^2 + \frac{D_{bit}}{2} \tag{3}$$

-continued $$y_{AC}|_{x=-L_{CB}} = y_{CB}|_{x=-L_{CB}} \tag{4}$$

$$y_{CB}|_{x=0} = \frac{D_{sta}}{2} + (D_{bit} - D_{sta}) \tag{5}$$

$$\frac{dy_{AC}}{dx}|_{x=-L_{AB}} = 0 \tag{6}$$

$$\left.\frac{dy_{AC}}{dx}\right|_{x=-L_{CB}} = \left.\frac{dy_{CB}}{dx}\right|_{x=-L_{CB}} \tag{7}$$

$$\left.\frac{d^2y_{AC}}{dx^2}\right|_{x=-L_{CB}} = \left.\frac{d^2y_{CB}}{dx^2}\right|_{x=-L_{CB}} \tag{8}$$

$$\left.\frac{d^2y_{CB}}{dx^2}\right|_{x=0} = 0 \tag{9}$$

$$-EI\left.\frac{d^3y_{AC}}{dx^3}\right|_{x=-L_{AB}} - F_c\left.\frac{dy_{AC}}{dx}\right|_{x=-L_{CB}} - EI\left.\frac{d^3y_{CB}}{dx^3}\right|_{x=-L_{CB}} - F_c\frac{dy_{CB}}{dx} = F_{pmax} \tag{10}$$

wherein, $F_c$=WOB×cos ($k_c\times L_{AB}$).

10. The computer system according to claim 9, wherein after the 8 coefficients to be solved are calculated, a lateral force on the drill bit is calculated:

$$F_d = EI\left.\frac{d^3y_{AC}}{dx^3}\right|_{x=-L_{AB}} + F_c\left.\frac{dy_{AC}}{dx}\right|_{x=-L_{AB}} - WOB\times\sin(k_c\times L_{AB}) \tag{11}$$

wherein, $F_d$ denotes the lateral force on the drill bit.

11. The computer system according to claim 10, wherein after the lateral force on the drill bit is calculated, the theoretical maximum build rate of the push-the-bit rotary steering device is calculated:

$$k_{max}=\text{FindRoot}(F_d=0,k_c) \tag{12}$$

wherein, $k_{max}$ denotes the maximum build rate; the theoretical maximum build rate is acquired by letting the lateral force $F_d$ on the drill bit be 0 and calculating the wellbore curvature $k_c$ in the expression; and FindRoot denotes a root-finding function.

12. The computer system according to claim 11, wherein after predicting the theoretical maximum build rate, measured well inclination data of a rotary steering tool with a same parameter during a drilling operation in a certain layer of a certain block is processed, and a measured maximum build rate of the rotary steering tool during drilling in the layer is calculated as follows:

a series of steering commands during the operation in the layer is assumed as comprising different steering force percentages and steering orientations, a starting well depth and an ending well depth of each steering command in an action period are defined, and a measured maximum build rate in a well depth interval under the action of the command is calculated:

wherein, $Inc_{st}$ denotes an inclination angle at a starting point of a steering command interval, and $Azi_{st}$ denotes an azimuth angle at the starting point of the steering command interval;

$$Dogleg_{max}^{i} = \frac{DoglegFun(Inc_{st}, Azi_{st}, Inc_{ed}, Azi_{ed})}{(MD_{ed} - MD_{st})\times\frac{SFR}{100}} \tag{13}$$

$MD_{st}$ denotes a well depth at the starting point of the steering command interval; $Inc_{ed}$ denotes an inclination angle at an ending point of the steering command interval; $Azi_{ed}$ denotes an azimuth angle at the ending point of the steering command interval; $MD_{ed}$ denotes a well depth at the ending point of the steering command interval; and DoglegFun denotes a dogleg calculation function for a trajectory formed in the steering command interval; and a set of measured maximum build rates for different steering commands during the operation in the layer is calculated, and a representative measured maximum build rate from n measured maximum build rates of the set is selected by using different filtering methods comprising a median taking method or an average taking method:

$$Dogleg_{max}=FilterFun(Dogleg_{max}^{1},Dogleg_{max}^{2},Dogleg_{max}^{3},\ldots,Dogleg_{max}^{n}) \quad (14)$$

wherein, FilterFun denotes a filtering function, and a corresponding filtering method is used as needed.

13. The computer system according to claim 12, wherein the correction factor α is calculated based on the measured maximum build rate and the theoretical maximum build rate:

$$\alpha = \frac{Dogleg_{max}}{k_{max}} \quad (15)$$

wherein, $k_{max}$ denotes the maximum build rate, and $Dogleg_{max}$ denotes the measured maximum build rate.

14. The computer system according to claim 13, wherein after the correction factor α is calculated, different parameters are substituted into the mechanical mathematical model expressed by Eqs. (1) to (12) to predict the maximum build rate $k_{RSS}$ of the push-the-bit rotary steering device in the same layer of the same block:

$$k_{RSS}=\alpha\times k_{max} \quad (16)$$

wherein, α denotes the correction factor, and $k_{max}$ denotes the maximum build rate.

* * * * *